US011193673B2

(12) United States Patent
Smith et al.

(10) Patent No.: US 11,193,673 B2
(45) Date of Patent: Dec. 7, 2021

(54) METHOD AND APPARATUS FOR CONTROLLING OPERATION OF BAKE AND BROIL ELEMENTS IN AN ELECTRIC OVEN

(71) Applicant: Brown Stove Works, Inc., Cleveland, TN (US)

(72) Inventors: Todd A. Smith, Cleveland, TN (US); Matthew H. Brown, Cleveland, TN (US)

(73) Assignee: Brown Stove Works, Inc., Cleveland, TN (US)

( * ) Notice: Subject to any disclaimer, the term of this patent is extended or adjusted under 35 U.S.C. 154(b) by 86 days.

(21) Appl. No.: 16/742,232

(22) Filed: Jan. 14, 2020

(65) Prior Publication Data

US 2020/0166217 A1 May 28, 2020

Related U.S. Application Data

(63) Continuation of application No. 15/497,270, filed on Apr. 26, 2017, now Pat. No. 10,571,133, which is a continuation-in-part of application No. 15/181,545, filed on Jun. 14, 2016, now Pat. No. 10,408,462.

(51) Int. Cl.

| | |
|---|---|
| ***H05B 6/68*** | (2006.01) |
| ***F24C 7/08*** | (2006.01) |
| ***F24C 7/04*** | (2021.01) |
| *H05B 1/02* | (2006.01) |

(52) U.S. Cl.

CPC ..... *F24C 7/088* (2013.01); *F24C 7/04* (2013.01)

(58) Field of Classification Search

CPC .... F24C 7/04; F24C 7/043; F24C 7/08; F24C 7/085; F24C 7/087; F24C 7/088; F24C 15/105; F24C 15/106; H05B 3/02; H05B 3/24; H05B 3/68; H05B 3/70; H05B 3/74; H05B 3/746; H05B 3/748; H05B 2213/04; H05B 2213/05; H05B 2213/07; H05B 1/0202; H05B 1/0258

USPC ..... 219/481, 443.1, 485, 446.1, 219/448.14–448.18, 452.12, 458.1, 462.1, 219/470, 471, 494, 448.11, 622, 624, 627, 219/660, 667, 675

See application file for complete search history.

(56) References Cited

U.S. PATENT DOCUMENTS 9,220,130 B1 * 12/2015 Smith ..... H05B 1/0266
2008/0105250 A1 * 5/2008 Elkasevic ..... F24C 15/12 126/19 R

* cited by examiner

*Primary Examiner* — Hung D Nguyen
(74) *Attorney, Agent, or Firm* — Miller & Marin PLLC; Stephen J. Stark

(57) ABSTRACT

An oven has at least one of bake and broil heating elements which have a temperature switch as a portion of the replaceable heating element. Upon reaching a predetermined temperature, the switch opens and power through the heating element is secured. Once temperature is reduced below another predetermined temperature, the switch closes for normal operation.

19 Claims, 5 Drawing Sheets

PRIOR ART

PRIOR ART

METHOD AND APPARATUS FOR CONTROLLING OPERATION OF BAKE AND BROIL ELEMENTS IN AN ELECTRIC OVEN

CLAIM OF PRIORITY

This application is a continuation application of U.S. patent application Ser. No. 15/497,270 filed Apr. 26, 2017, which is a continuation in part application of U.S. patent application Ser. No. 15/181,545 filed Jun. 14, 2016, which is incorporated by reference herein in its entirety.

FIELD OF THE INVENTION

The present invention relates to a method and devices for controlling the temperature of an electric oven in an effort to prevent the oven from damaging itself or areas surrounding the electric oven.

BACKGROUND OF THE INVENTION

Efforts have been made to curtail a risk of cooking fires from an electric stove.

U.S. Pat. No. 6,246,033 provides a method and apparatus for controlling operation of a range-top coil heating element. After ten years of use in the market, this device still has not received wide-spread acceptance. Specifically, when installed on test ranges the applicant, the device has consistently prevented water from boiling.

The applicant developed the technology of U.S. Pat. No. 9,220,130, which is a substantial improvement over prior art constructions for range-top coils. However, neither of these patents address abnormal operation of cooking elements within an electric oven which are commonly referred to as the bake and broil elements.

UL858 is a standard for Safety of Household Electric Ranges. Section 72 prescribes a series of tests for abnormal operation. To pass some of these tests, no molten or flaming material can be ejected from the unit, no compromised electrical wiring, no scorching of cheesecloth within the test enclosure, and a fuse in line with the grounding conductor cannot open.

There are two known prior art techniques which can assist in passing the safety standard. First, one can limit the overall wattage generated by heating elements within the oven. However, while this can provide a safe oven, it requires a balance to find a wattage whose heat input can match an equilibrium of heat loss to maintain oven temperatures that should not place the wiring or other electrical components in jeopardy. The wattage limitations can permit the cooking appliance to pass the standards without a need for additional safeguards. However, this technique can also limit the oven's utility such as requiring longer than desired time to preheat to cooking temperatures.

The second technique known to be used to pass the safety standard is to provide redundant controls within the oven walls (not within the cooking chamber of the oven). The redundant controls act as a safety switch to secure electrical flow to at least one of the terminal connections (normally a female spade connection) which connect to one of the bake and broil elements to thereby prevent the flow of electricity through the affected bake/broil element when reaching a predetermined condition. A mechanical safety switch circuit has been used by at least some manufacturers which provides for the sensing of temperature, and if exceeding a predetermined amount, disengaging a connection to thereby prevent flow of electricity to the bake/broil element(s) at a location between the terminal connecting to the element and the temperature controls. By interrupting the circuit, damage to the cooking appliance and possibly the home can be prevented. Once temperature near the sensor drops, the switch can reset the circuit.

This second method requires additional controls which will likely need to be subjected to separate independent testing. Technical expertise or engineering will likely dictate the location of the circuitry and sensing location so as to produce safe and repeatable results. Furthermore, if the temperature for the circuit is set too low, the circuit could prevent normal cooking operations even when there is no overheating condition present. If the setting is too high, the circuitry might fail to perform its safety function as intended.

Accordingly, an improved electric oven and/or bake elements and/or broil elements is believed to be desirable in the marketplace.

SUMMARY OF THE INVENTION

It is an object of many embodiments of the present invention to provide at least one of a device and method for limiting the temperature generated at least in part by bake and/or broil elements within an electric oven.

It is another object of many embodiments of the present invention to provide an improved device and method for sensing temperatures at a location spaced from the heating portions of the oven element so as not to sense a significant amount of conducted heat, but instead primarily sense heat radiated from a traditional element construction throughout the oven space in the normal manner so that a structure similar to traditional heating elements can easily be installed and/or replaced together with the sensor.

It is another object of many embodiments of the present invention to provide an improved apparatus and method for sensing temperature related to a bake and or broil element with a switch activated along a portion of the element themselves, preferably located within the cooking area of the oven for many embodiments.

It is another object of many embodiments of the present invention for the bake and/or broil element to have a temperature sensor connected to the element and a switch located along the element, normally between the two electrical connectors, which could be spade style connectors or others, whereby upon sensing a predetermined temperature, the switch opens between the connectors to prevent further electrical flow, and thus resistance heating of the element into the heating chamber.

Accordingly, in accordance with a presently preferred embodiment of the present invention, an oven is provided having at least one of bake and broil elements. The bake element is normally located at a bottom of the cooking chamber, the broil element is normally located at the top of the cooking chamber. These elements normally have electrical connectors at ends of the elements which connect to cooperating electrical connectors as part of the internal wiring of the cooking appliance, usually internally of the appliance, but normally outside of and/or behind the cooking chamber. The element will often have a mounting plate which secures the element to a rear wall of the cooking chamber, and very often, the bake element may have feet to assist in supporting it above a bottom of the cooking chamber. At least internal to the cooking chamber, the bake and broil elements provided resistive heating portions.

What is different about the applicant's bake and/or broil elements is the presence of a switch disposed along a portion of the elements (i.e., between the connectors which connect the elements to the stove), which can open to prevent the flow of electricity through the affected element, possibly with no need to modify the oven construction. The switch at least receives a signal if not is directly connected to a temperature sensor (such as being a portion of a Thermo Disc™ or otherwise provided) whereby upon reaching a predetermined temperature, the switch opens to prevent the continued input of heat through the element at issue. Once a temperature drops below another predetermined setting, the switch can reset to permit normal operation of the element at issue.

For many embodiments, the switch and/or sensor can be located along a cold rod (i.e., a non-heating part of the element). For ovens having a design intended only for the utility of cooking operations where the maximum temperature setting may be 500 F or 550 F, the predetermined setting for the switch might be 600 F. For self-cleaning ovens, which might reach temperatures of 800 F-850 F, the setting would likely be higher, such as 900 F, or other appropriate setting. Some embodiments may have a sensor spaced from the switch. Others may have the sensor located adjacent to, or at least near the switch. Still other embodiments may provide a sensor which can move to initiate switch action (i.e., like a Therm-O-Disc™).

Accordingly, an improved method and apparatus for controlling operation of electric heating elements within an oven is provided. Specifically, a temperature sensing device is preferably located along an element and/or preferably within the heating space or cooking chamber of an oven. The temperature sensing device may sense temperature, and thereby open a circuit along the bake and/or broil element(s) upon reaching a predetermined temperature, in an attempt to keep the temperature of the oven and/or materials therein below an ignition temperature of material commonly cooked in cooking appliances and/or in an effort to prevent the oven from exceeding abnormal operating thresholds. Should the oven provide a continuous heating amperage to the element(s), the switch located as a part of the element(s) can affect the ceasing in flowing of current (and thus resistive heating), if outside of prescribed temperature ranges, preferably without interrupting designed operation of the oven.

Many embodiments have temperature controlled switches connected directly to the heating elements. The bake and broil heating elements are received in terminal connectors in the range. Some of the switches and/or sensors are disposed along at least substantially unheated portions of the elements, such as along cold rod portions.

Accordingly, a temperature circuit interruption activated switch can be provided, preferably as a portion of the heating elements in an effort to reduce temperatures below a targeted threshold in the cooking chamber placed thereon at an upper limit and then restore electricity when temperature is below a lower limit. While not guaranteeing the elimination of cooking fires or other oven problems, the statistical likelihood of such problems can be dramatically reduced.

In many ovens, the temperature switch may be supported by a housing, such as one connected to a portion of the elements. The temperature activated switch may be sealed to the housing to prevent moisture such as from an overflowed cooking container, or otherwise, from seeping onto an electrical contact or multiple contacts in an undesired manner. Furthermore, the temperature activated switch is preferably wired for many embodiments in series with the heating element without a need for a separate processor. However, other embodiments may include a processor which may include a switch connected to a temperature sensor for more sophisticated embodiments. Providing a temperature activated switch which can withstand oven temperature for the life of the element is also highly desirable. Ceramics and steels may be used with at least certain portions of the switch and/or sensor.

BRIEF DESCRIPTION OF THE DRAWINGS

The particular features and advantages of the invention as well as other objects will become apparent from the following description taken in connection with the accompanying drawings in which.

DETAILED DESCRIPTION OF THE DRAWINGS

Figure 1:
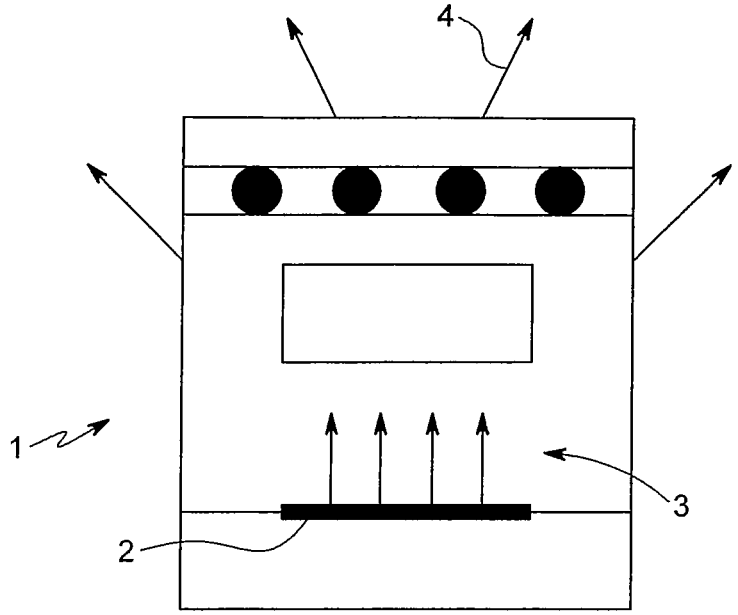
FIG. 1 PRIOR ART
FIG. 1 is a schematic representation of a first prior art oven design.

FIG. 1 shows a first prior art design for an oven 1. This oven limits the wattage of the element(s) 2 inside the oven as a means to control abnormal operation of the appliance, such as is prescribed by UL858 and/or other measures to protect the oven and house where the oven is utilized. An object of this type oven 1 is to find a wattage has a continuous heat input 3 matching, but not exceeding, a heat loss 4 of the oven 1 so as to not place wiring, electric components, or other components of the oven 1 in danger of failure or burning. Accordingly, these type ovens 1 do not normally have a capability to heat beyond a temperature limit which could be described as a critical target. Selecting the critical target temperature can be challenging. The critical target temperature should be high enough to perform normal operations of the appliance, but not so high as to put the appliance or home at risk.

Effective wattage limits on the oven heating elements can be beneficial in that the cooking appliance, i.e., an oven 1, can pass the abnormal operation tests of UL858 without extra technical needs of redundant controls. However, this method may limit the utility of the oven 1 such as by requiring longer than desired times to preheat to cooking temperature.

Figure 2:
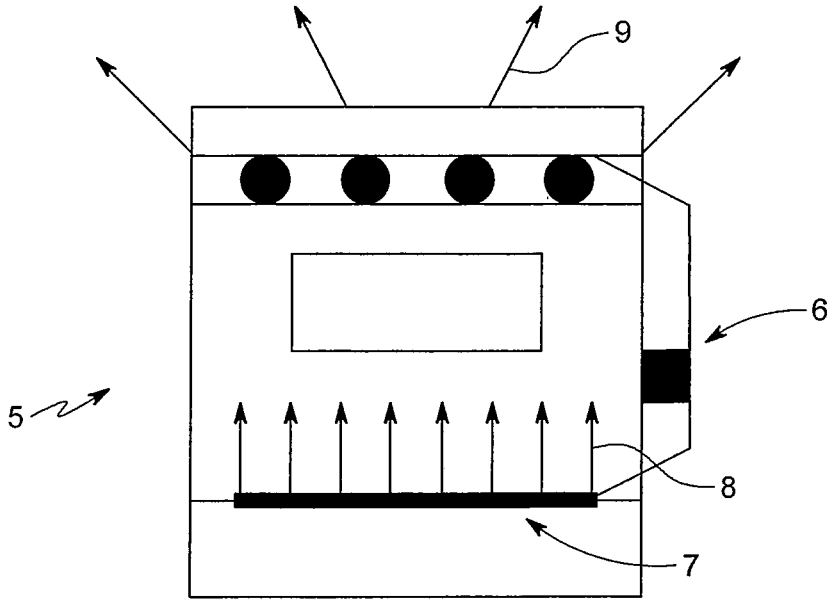
FIG. 2 is a schematic representation of a second prior art oven design.
Figure 3:
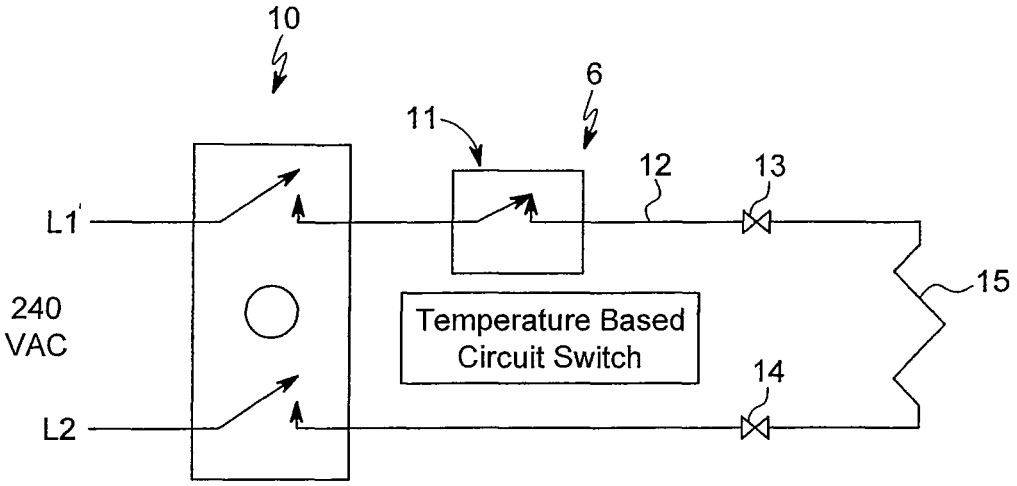
FIG. 3 is a schematic wiring diagram of the oven design of FIG. 2.
Figure 4:
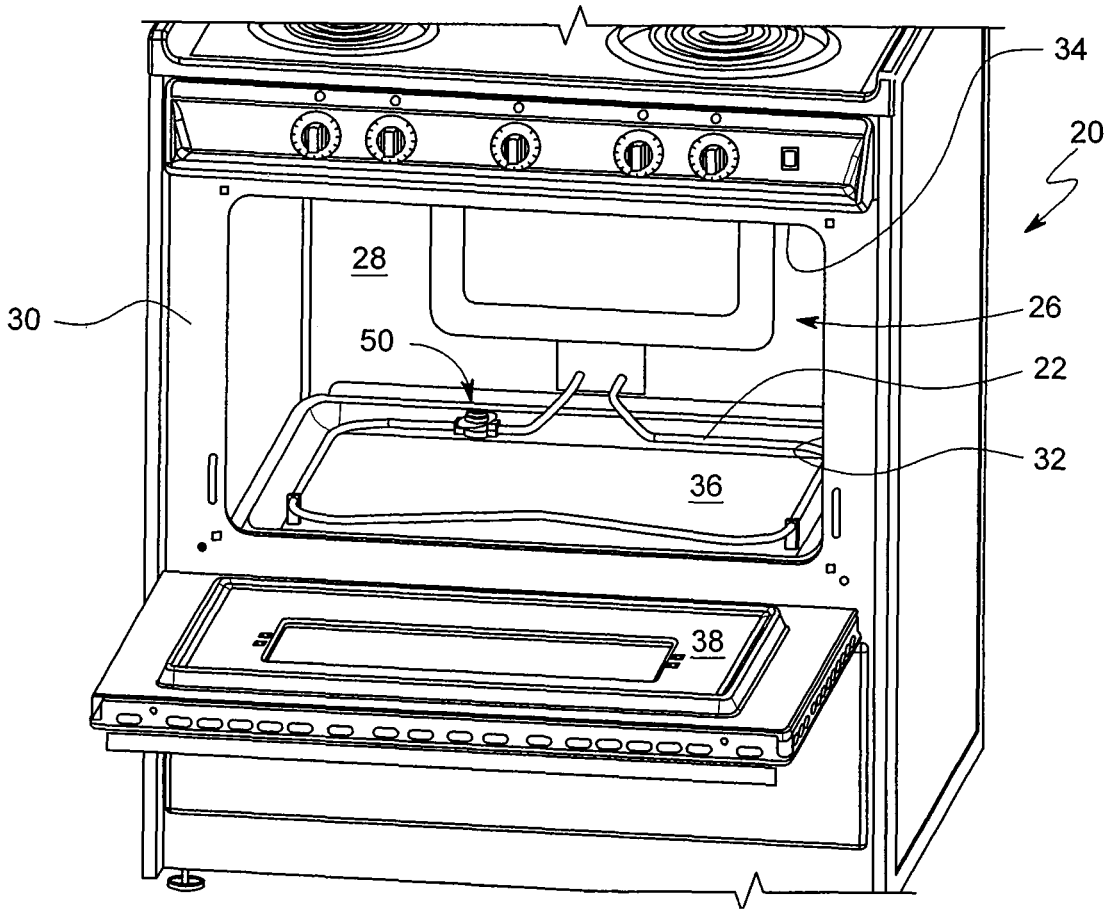
FIG. 4 is a top perspective view of an oven of a presently preferred embodiment of the present invention showing a bake element of a preferred embodiment installed therein.
Figure 5:
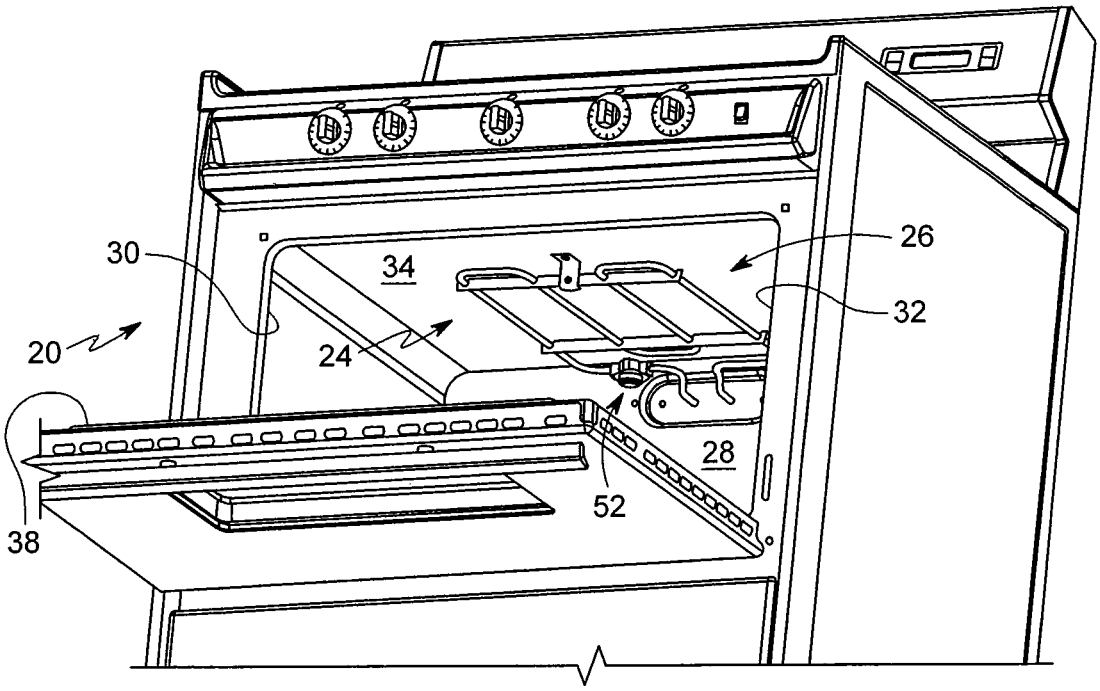
FIG. 5 is a bottom perspective view of the oven of FIG. 4 showing a broil element of a preferred embodiment installed therein.
Figure 6:
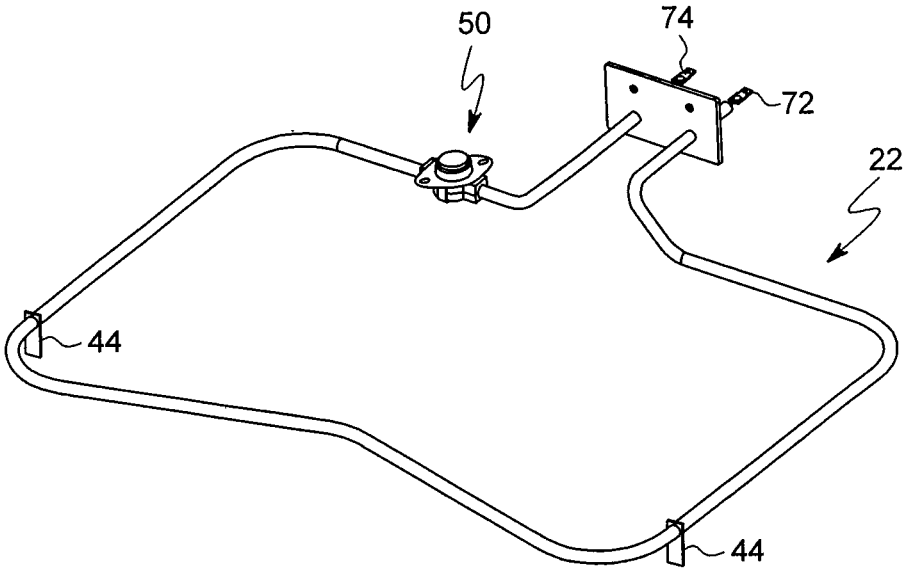
FIG. 6 is a top perspective view of the bake element shown in FIG. 4 removed from the oven.
Figure 7:
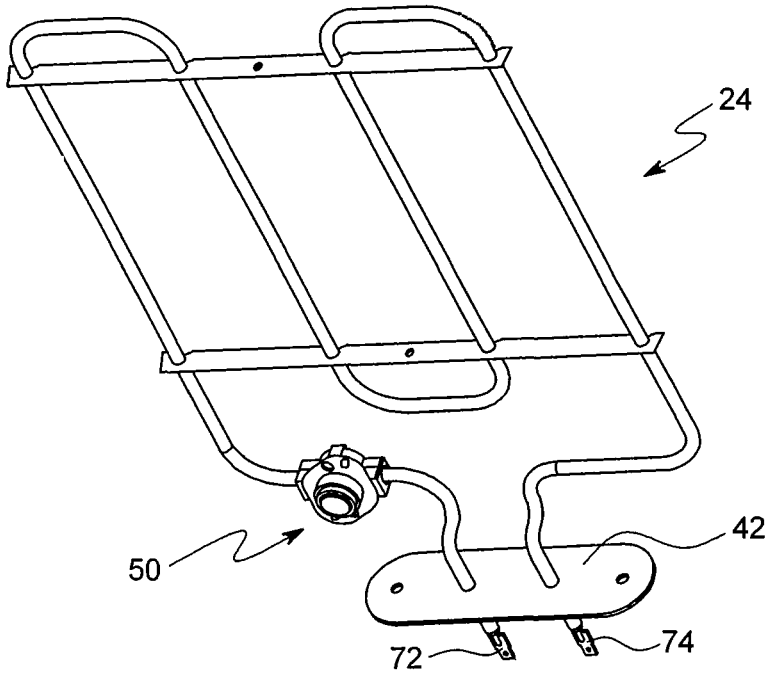
FIG. 7 is a top perspective view of the broil element shown in FIG. 5 removed from the oven.
Figure 8:
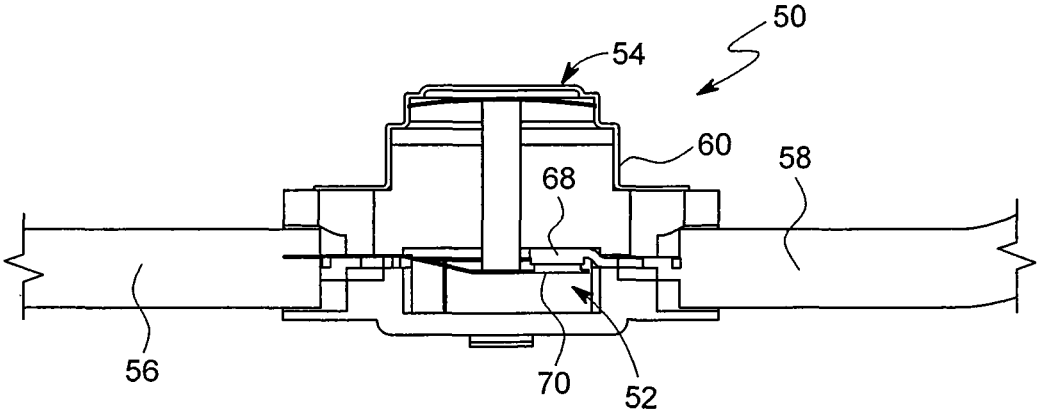
FIG. 8 is a cutaway side view of temperature switch and sensor combination as is shown in FIGS. 4-7.

Accordingly, a second common prior art design is shown for an oven 5. Shown in FIGS. 2 and 3 there are redundant controls 6 provided (in addition to the user-controlled controls 10, shown in FIG. 3, such as bake/broil and/or temperature settings) which can be utilized as a way to address abnormal operation compliance. These components will likely require additional components in the oven 5 not found in oven 1 which can add to the technical engineering and design considerations along with a likely need for independent testing and certification to be used in the oven 5 as sold in the marketplace. The prior art redundant controls 6 are located within the oven 5 (but outside of the cooking chamber). The redundant controls 6 can secure the flow of electricity through the element(s) 7 so as to limit heat input 8 relative to heat output 9.

One type of redundant controls 6 is a temperature based circuit interruption switch 11. This device is a switch that is in line with the oven element circuit wire 12 which provides a path for current to flow through the terminals or connectors 13,14 into and through the element 15 to generate heat during normal operation. Voltage between L1 and L2 is normally 240 VAC. This voltage is then directed through user controls 10 to turn on and/or provide a temperature setting to be achieved by the element(s) 15.

In the event the oven 5 malfunctions, most likely due to a malfunction of the user controls 10, thereby locking the oven 5 into a runaway temperature condition, temperatures at or sensed for the switch 11 exceed normal use temperatures. At a predetermined temperature point, the switch 11 can open to disengage the circuit to prevent damage to the cooking appliance, i.e., the oven 5 shown, cooking articles in the oven 5, and/or possibly the home or location of the oven 5 and/or anything in the oven 5. Once temperatures drop, the switch 11 can reset the circuit.

Empirical testing will likely be needed to verify the parameters of the switch 11 at its mounting location inside the oven 5 (but not in the cooking chamber). If the switch 11 is set too low, it could interrupt normal cooking operations when there is no overheating condition present. If the switch parameter is too high, it could fail to perform its safety function as intended.

A presently preferred embodiment of the present invention is shown in FIGS. 4-8 in the form of a cooking appliance in the form of an electric oven 20 having bake element 22 and/or broil element 24. These bake and/or broil elements 22,24 are shown located in the cooking chamber 26 of the oven 20. The cooking chamber 26 is normally defined by a back 28, sides 30,32, top 34, bottom 36 and a front door 38 (when closed). The bake and/or broil elements 22,24 normally extend from, if not connect to the back 28 inside the cooling chamber 26. Mounting plates 40,42 may assist in connecting the bake and/or broil elements 22,24 to the back 28, while feet 44 may assist in supporting bake element 22 above the bottom 36, and mounting bracket 46 may assist in connecting broil element 24 to the top 34. So far, this is not different than prior art ovens.

What distinguishes the presently preferred embodiment of oven 20 from prior art designs are the bake and/or broil elements 22,24 themselves. The bake and/or broil elements 22,24 have integral temperature activated switches 50 which preferably include both a switch 52 as well as a temperature sensor 54. The temperature sensor 52 may even play a direct mechanical role in the engagement and/or disengagement of the switch 52 between a closed an open position (such as for a Therm-O-Cell™ construction or otherwise) as will be discussed in further detail below.

The bake and/or broil elements 22,24 can have switches 50 which can provide for redundant high temperature limiting control as a part of the heating element 22 and/or 24 itself instead of relying on components within the oven itself. Mechanical means of temperature based circuit interruption can be provided with temperature activated switch 50 or otherwise. The temperature activated switch 50 may be connected to an element rod portions 56,58 shown in FIG. 8 which form portions of the bake and/or broil elements 22,24.

For many embodiments, it is anticipated that the rod portions 56,58 immediately adjacent the temperature activated switches 50 will be cold rod portions (i.e., does not generate heat when active), but it is possible that they could be hot leg (or heated portions or other portions) for other embodiments.

Settings for the temperature sensor 52 to provide at least a signal, if not motive force, to disengage the switch 54, can target a cooking chamber 26 or oven space that is higher than normal operation, such as slightly higher. For non-self-cleaning ovens, this could be set at approximately about 600 F as typical cooking functions occur at less than that temperature. For self-cleaning ovens, the target parameter of the switch 54 or 50 could be set at approximately 900 F since most self-cleaning oven operations occur at temperatures between 800 F and 850 F. Other predetermined temperatures can be used for various embodiments. Resetting of the switch (closing the switch 54) may occur at 25 F or other setting below the predetermined setting to open, or other setting.

Design considerations for the temperature activated switch 50 can be based on temperature and electrical capacities needed for its operation. Since the temperature activated switch 50 will be located within the cooking chamber 26, the switch body 60 and internal components can be made to withstand oven temperatures such as ceramic, steel and/or other materials. Conductors 62,64 within the temperature activated switch 50 can provide a sufficient cross sectional area for the amount of current to flow through the temperature activated switch 50 when in its normal operating configuration.

For the illustrated embodiment, sensor 54 is a disc which flexes at least a certain amount at a predetermined temperature to move rod 66 so as to disengage contacts 68,70 at the predetermined temperature. At that or another lower predetermined temperature, the sensor 54 returns towards its initial position sufficiently for contacts 68,70 to re-engage. Other temperature activated switches 50 may operate differently than the illustrated temperature disc switch. Sensor 54 may not provide a direct mechanical drive to switch 52 for all embodiments. In fact, sensor 52 may be remote relative to switch 54 and provide at least a signal to open and/or close. In some embodiments, sensor 52 may be located in a switch housing 60 with the switch 54. In some embodiments, sensor 52 may be adjacent to switch 54, etc.

No party is known to provide a temperature activated switch 50 as a portion of a two terminal bake or broil element 22,24 for securing electrical power through the burner element 22 and/or 24 upon reaching a predetermined temperature. This allows for burner element manufacturers to provide elements 22 and/or 24 to manufacturers and/or consumers for use in the marketplace to replace existing elements and/or work with specific models of stoves to stop and/or prevent a situation of an abnormal operation.

No party is known by the applicant to provide a switch and/or sensor as a portion of two pronged element 22,24 located as a portion of the bake or broil element 22,24 for use in securing electricity through a particular heating element upon exceeding a predetermined upper limit and then restoring power when dropping below a predetermined lower limit.

Furthermore, no party is known to provide a temperature activated switch 50 and/or sensor 52 and/or switch 54 which is along a cold rod portion of the bake and/or broil elements 22,24, and particularly those which are triggered at least principally by radiant heat as opposed to conductive heat.

One potential drawback of this design is that a consumer could replace the bake or broil elements 22,24 shown herein with traditional bake or broil elements (which do not have temperature activated switches 50). However, in order to prevent such an action the connectors 72,74 could be configured so that the elements 22,24 could be received within cooperating connectors (not shown) of the oven 20, but those prior art elements be incompatible with socket cooperating connectors of new ovens designed to be used with the new elements 22,24. Other design considerations could also be employed.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. An electric cooking appliance comprising:

a first electric heating element inside a cooking chamber of the cooking appliance having connectors connected internally to the cooking appliance to receive a flow of electricity from a heat controller; and a temperature activated switch connected electrically in series with the first electric heating element intermediate the connectors internal to the cooking chamber, and the temperature activated switch is physically connected to the first electric heating element, said temperature activated switch having a housing receiving and extending beyond and outer perimeter of an upper surface of the temperature activated switch; and first and second rod portions of the first electric heating element connect to the temperature activated switch internal to portions of the housing, wherein upon reaching a predetermined upper temperature, the temperature activated switch opens thereby preventing the flow of electricity through the first electric heating element and when the temperature is below a predetermined lower temperature, the temperature activated switch closes permitting the flow of electricity through the first electric heating element.

2. The electric cooking appliance of claim 1 wherein the first and second rod portions of the heating element are spaced apart from one another internal to the housing.

3. The electric cooking appliance of claim 2 wherein the temperature activated switch has a sensor connected to the housing.

4. The electric cooking appliance of claim 3 wherein the sensor pushes apart contacts at the predetermined upper temperature to prevent the flow of electricity.

5. The electric cooking appliance of claim 1 wherein the temperature activated switch has a temperature sensor and a switch combination in a housing.

6. The electric cooking appliance of claim 1 wherein the first electric heating element is selected from the group of a bake element and a broil element.

7. The electric cooking appliance of claim 6 wherein the first electric heating element is a bake element and further comprising a second electric heating element as a broil element.

8. The electric cooking appliance of claim 6 wherein the first electric heating element is a broil element and further comprising a second electric heating element as a bake element.

9. The electric cooking appliance of claim 1 wherein the temperature activated switch is radiantly heated in the cooking chamber.

10. The electric cooking appliance of claim 1 wherein the predetermined upper temperature is selected to prevent a runaway temperature event.

11. The electric cooking appliance of claim 1 wherein the temperature activated switch is a temperature disc.

12. An electric heating element for use with an electric oven comprising:

a resistance heating element which provides radiant heat into a cooking chamber upon receipt of electricity from a first to a second connector;

a temperature activated switch physically connected to the resistance heating element and electrically connected in series with the resistance heating element, with the temperature activated switch located intermediate the first and second connector, and the temperature activated switch physically connected to the resistance heating element, said temperature activated switch having a housing receiving and extending beyond and outer perimeter of an upper surface of the temperature activated switch; and first and second rod portions of the resistance heating element connect to the temperature activated switch internal to portions of the housing, wherein when reaching a predetermined upper temperature, the temperature activated switch opens thereby preventing the flow of electricity intermediate the first and second plug in connections through the resistance heating element, and when the temperature drops below a predetermined lower temperature, the temperature activated switch closes thereby permitting the flow of electricity through the first and second plug in connections through the resistance heating element.

13. The electric heating element of claim 12 in combination with an oven having a cooking chamber.

14. The electric heating element of claim 13 wherein the oven has female connectors which receive the first and second connectors and the temperature activated switch is located within the cooking chamber.

15. The electric heating element of claim 13 wherein the electric heating element is one of a bake and a broil element in the oven.

16. The electric heating element of claim 12 wherein the electric heating element is one of a bake and a broil element.

17. The electric heating element of claim 12 wherein the temperature activated switch has a switch and a sensor.

18. The electric heating element of claim 12 wherein the switch is located intermediate cold rod portions of the heating element.

19. The electric heating element of claim 12 wherein the temperature activated switch is a temperature disc switch.

* * * * *